US010665999B2

(12) United States Patent
Wilson et al.

(10) Patent No.: US 10,665,999 B2
(45) Date of Patent: May 26, 2020

(54) SHIELDED COAXIAL TERMINATION DEVICE

(71) Applicant: PCT International, Inc., Mesa, AZ (US)

(72) Inventors: Brandon Wilson, Phoenix, AZ (US); Timothy L. Youtsey, Tempe, AZ (US)

(73) Assignee: PCT International, Inc., Mesa ( * ) Notice: Subject to any disclaimer, the term of this patent is extended or adjusted under 35 U.S.C. 154(b) by 0 days.

(21) Appl. No.: 16/290,701

(22) Filed: Mar. 1, 2019

(65) Prior Publication Data

US 2019/0273345 A1 Sep. 5, 2019

Related U.S. Application Data

(60) Provisional application No. 62/637,364, filed on Mar. 1, 2018.

(51) Int. Cl.

| | |
|---|---|
| ***H01R 9/05*** | (2006.01) |
| ***H01R 24/40*** | (2011.01) |
| ***H01R 13/6583*** | (2011.01) |

(52) U.S. Cl.

CPC ..... *H01R 24/40* (2013.01); *H01R 9/0518* (2013.01); *H01R 9/0527* (2013.01); *H01R 13/6583* (2013.01)

(58) Field of Classification Search

CPC .. H01R 13/658; H01R 13/6581; H01R 24/40; H01R 13/6583; H01R 9/0527; H01P 1/30

USPC ..... 439/578

See application file for complete search history.

(56) References Cited

U.S. PATENT DOCUMENTS

| | | | | |
|---|---|---|---|---|
| 9,178,317 | B2 * | 11/2015 | Holland | H01R 13/658 |
| 10,340,638 | B2 | 7/2019 | Goebel et al. | |
| 10,381,702 | B2 * | 8/2019 | Alkan | H01P 1/30 |
| 2016/0006145 | A1 * | 1/2016 | Goebel | H01R 13/6581 439/345 |
| 2018/0212367 | A1 | 7/2018 | Holland | |
| 2018/0233836 | A1 | 8/2018 | Ehret et al. | |
| 2019/0067881 | A1 | 2/2019 | Hanson et al. | |

* cited by examiner

*Primary Examiner* — Jean F Duverne

(74) *Attorney, Agent, or Firm* — Thomas W. Galvani, P.C.; Thomas W. Galvani

(57) ABSTRACT

A shielded coaxial termination device includes a center conductor having a front end and a barrel encircling the center conductor. The barrel includes a front end and an annular sidewall defining an interior configured to receive and electrically couple with a coaxial post. A shield, having a front end and an opposed rear end, is mounted to the barrel so as to deploy from a retracted position toward an advanced position to radially cover the center conductor when the barrel is not fully installed on a coaxial post.

20 Claims, 4 Drawing Sheets

SHIELDED COAXIAL TERMINATION DEVICE

CROSS-REFERENCE TO RELATED APPLICATIONS

This application claims the benefit of U.S. Provisional Application No. 62/637,364, filed Mar. 1, 2018, which is hereby incorporated by reference.

FIELD OF THE INVENTION

The present invention relates generally to electronic devices, and more particularly to RF devices.

BACKGROUND OF THE INVENTION

Electronic devices and components used in and around homes and businesses produce noise affecting radio-frequency ("RF") signals transmitted through nearby coaxial cables. All types of devices produce such noise, even the coaxial cables themselves. Noise can be caused by manufacturing or installation defects, by imperfections in various electronic devices or components or electronic cables, and by poor or inadequate shielding. Conventional shielding that may have once been adequate is becoming less and less effective with the continuing proliferation of electronic devices. Communication in the 5G band creates particularly insidious noise issues. Ingress noise has become a serious problem impacting signal quality in television, voice, security, and broadband services.

Shielding is used in a variety of electronic cables and devices to reduce outside electrical interference or noise that could affect an RF signal travelling through the cable or other device. The shielding also helps prevent the signal from radiating from the cable or other device and then interfering with other devices. Generally, shielding covers the length of a cable. Dual, triple, and even quadruple-shielded cables are becoming standard in an attempt to mitigate the effects of RF noise.

However, while the lengths of the cables themselves may be shielded, many connectors, posts, and other coaxial termination devices remain susceptible to noise ingress. Connectors, posts, and other coaxial termination devices can even become a source of noise egress. For example, if a homeowner disconnects a cable without properly terminating it, or without disconnecting the other end, RF noise can be emitted from the cable. RF noise can also enter that cable and propagate through the center conductor to the component to which the cable is connected, where the noise may then spread in the system. Systems and methods for mitigating RF noise ingress and egress at a coaxial termination point are needed.

SUMMARY OF THE INVENTION

An embodiment of a shielded coaxial termination device includes a center conductor having a front end and a barrel encircling the center conductor. The barrel includes a front end and an annular sidewall defining an interior configured to receive and electrically couple with a coaxial post. A shield, having a front end and an opposed rear end, is mounted to the barrel so as to deploy from a retracted position toward an advanced position to radially cover the center conductor when the barrel is not fully installed on a coaxial post.

An embodiment of a shielded coaxial termination device includes a barrel having an annular sidewall and an interior configured to receive and electrically couple with a coaxial post. A center conductor encircles the sidewall, and a shield moves between a retracted position and an advanced position over the barrel in which the shield radially covers the center conductor. The shield moves toward the retracted position in response to application of the termination device at least partially onto a coaxial post, and the shield moves toward the advanced position in response removal of the termination device at least partially from the coaxial post.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
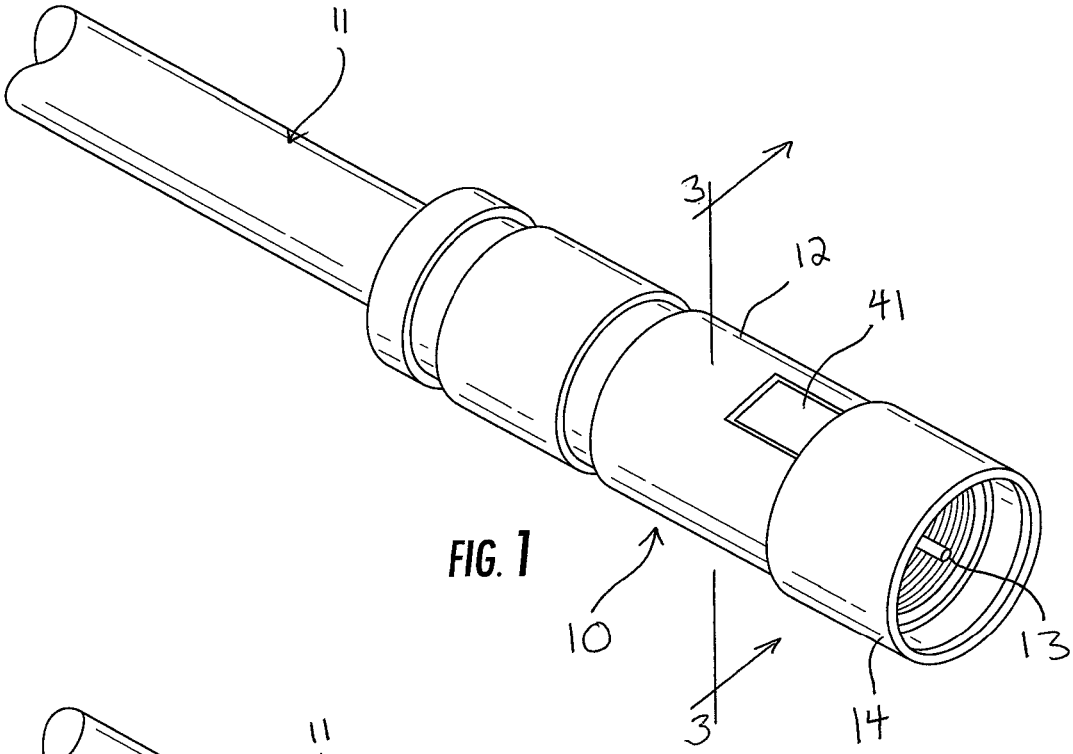
FIGS. 1 and 2 are perspective views of a shielded coaxial termination device with a shield in advanced and retracted positions, respectively.
Figure 2:
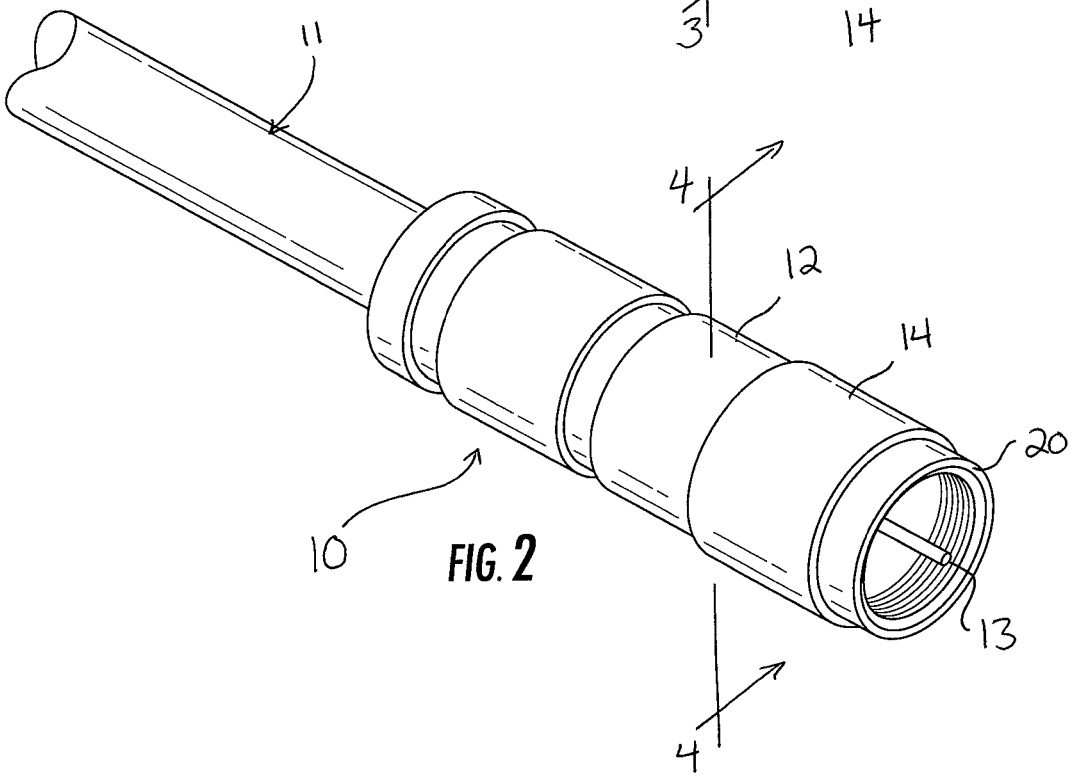

Reference now is made to the drawings, in which the same reference characters are used throughout the different figures to designate the same elements. FIGS. 1 and 2 are perspective views of a shielded coaxial termination device 10 (hereinafter "connector 10") applied to a cable 11. The connector 10 includes a barrel 12, a center conductor 13 encircled by the barrel, and a moveable shield 14 mounted to the barrel 12 to move between an advanced position, as shown in FIG. 1, and a retracted position, as shown in FIG. 2. The shield 14 protects the connector 10 from radio frequency interference ("RFI") ingress before and during installation on a coaxial post 15 (shown only in broken line in FIG. 4), and also mitigates RFI egress before and during installation.

Figure 4:
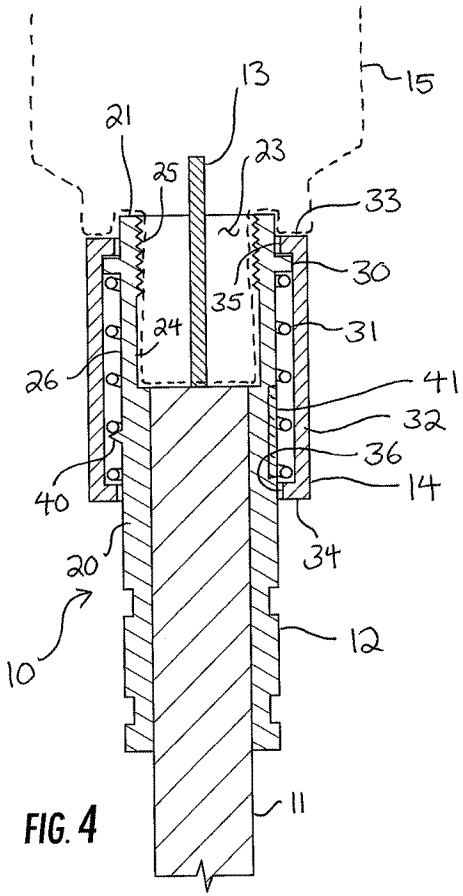
FIGS. 3 and 4 are section views taken along lines 3-3 and 4-4, showing the shielded coaxial termination device therein with the shield in the advanced and retracted positions, respectively.
Figure 3:
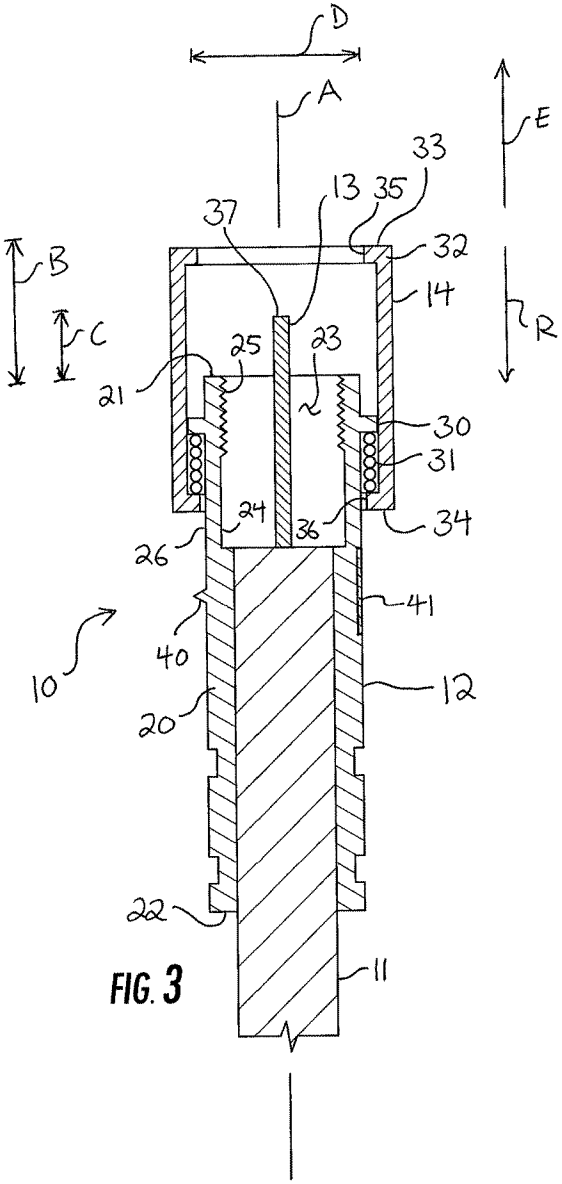

Referring now also to FIGS. 3 and 4, the connector 10 includes the barrel 12 having an annular sidewall 20 extending between an open front end 21 and an opposed rear end 22. In the embodiment shown in these drawings, the sidewall 20 is snugly fit and crimped onto the cable 11. In other embodiments, the connector 10 may be formed onto the cable 11, such as with an integral jacket that covers both the connector 10 and the cable 11. In other embodiments, the connector 10 may be pushed onto the cable 11 to secure it thereto. All of these embodiments are considered within the scope of this disclosure, and the drawings show just one exemplary embodiment. In these drawings, the cable 11 is shown without detail, but one having ordinary skill in the art will appreciate that the cable is constructed with a dieletric insulator, braid and/or foil layers, and a jacket, all of which surround the center conductor 13.

The sidewall 20 is cylindrical and bounds and defines a hollow, cylindrical interior 23. An inner surface 24 of the sidewall 20 is formed with threads 25 which engage with the coaxial post 15 when the connector 10 is applied thereto. In some embodiments, the threads 25 are replaced with ribs or other engagement structure for coupling to the coaxial post 15. The interior 23 is sized, shaped, and configured to receive and electrically couple with the coaxial post 15.

Just behind the front end 21 of the sidewall 20, a radially-extending lip 30 is formed to an outer surface 26 of the sidewall 20. The lip 30 extends continuously around the sidewall 20 parallel to the open front end 21 and projects outwardly on the barrel 12. The lip 30 has a generally rectangular cross-section. The outer surface 26 of the sidewall 20 behind the lip 30 is substantially smooth. The lip 30 serves as a forward stop for a spring 31 captured by the connector 10, as will be explained later.

The shield 14 is fit over the sidewall 20 of the barrel 12. The shield 14 has a rigid cylindrical sidewall 32 extending between an open front end 33 and an open rear end 34. Inwardly-extending front and rear flanges 35 and 36 are formed at the front end 33 and rear end 34, respectively. The flanges 35 and 36 both have a generally rectangular cross-section and define an inner diameter D of the shield 14. This inner diameter D corresponds to the outer diameter as measured around the outer surface 26 of the sidewall 20 of the barrel 12. In this way, the shield 14 is mounted to the barrel 12 to move between an advanced position, shown in FIG. 3, to a retracted position, shown in FIG. 4.

In the advanced position shown in FIG. 3, the shield 14 is advanced forwardly so that it extends out beyond the front end of the connector 1, covering the center conductor 13. The front end 33 of the shield 14 is in front of the front end 21 of the barrel 12 and is also in front of a front end 37 of the center conductor 13. The rear end 34 of the shield 14 is behind the front end 21 of the barrel 12. Briefly, it is noted that terms such as "in front," "ahead," "behind," and the like describe the relative position, orientation, or arrangement of an element or elements along a longitudinal axis A extending through the connector 10, and are made in the context that the front end 21 of the barrel 12 is in front of the rear end 22 of the barrel 12. The shield 14 moves axially along the longitudinal axis A in a forward direction to the advanced position and axially in a rearward direction to the retracted position. The connector 10 generally has rotational symmetry about the longitudinal axis A.

The lip 30 serves as a forward stop for advancement of the shield 14 over the barrel 12. When the shield 14 is moved fully to its advanced position, the spring 31 between the lip 30 and the rear flange 36 is fully compressed such that its windings come into contact with each other. The lip 30, acting through the compressed spring 31, indirectly interacts with and prevents the rear flange 36 from moving further forward. In other words, the lip 30 and the spring 31 act as a forward stop to further forward movement of the shield 14 on the barrel 12.

When the shield 14 is in the advanced position, the front end 33 of the shield 14 is spaced apart from the front end 21 of the barrel 12 by a distance B, as shown in FIG. 3. This distance is approximately twice a length C, where the length C is the axial distance between the front end 37 of the center conductor 13 and the front end 21 of the barrel 12. In other words, the shield 14 extends approximately twice as far axially beyond the barrel 12 than does the center conductor 13. This distance B corresponds roughly to the inner diameter D of the shield 14, such that the distance B is within approximately ten percent of the inner diameter D. Such correspondence between the distance B, distance C, and inner diameter D effectively mitigates RFI ingress and egress to and from the center conductor when the shield 14 is in the advanced position.

Indeed, when the shield 14 is in the advanced position, the center conductor is radially covered, concealed, and shielded. The shield 14 is constructed from a conductive material or combination of conductive materials suitable for blocking RFI ingress and egress, such as copper, nickel, aluminum, or other metal. When the shield 14 is in the advanced position thereof, RFI ingress and egress is limited in entering the cable 11 through anywhere other than the mouth at the open front end 33; RFI ingress and egress in a radial direction is prevented by virtue of the radial coverage of the shield 14. Because the shield 14 is biased into the advanced position, when the connector 10 is disconnected from the coaxial post 15, the shield 14 automatically moves into the advanced position and blocks the ingress and egress of most RFI.

The spring 31 is located between the outward lip 30 and the inward rear flange 36, and it is a tension spring 31. The spring 31 is attached to the lip 30 and also to the rear flange 36, and it acts to axially compress the distance between the lip 30 and the flange 36, so that the spring 31 biases the shield 14 into the advanced position. In an alternate embodiment of the connector 10, the spring 31 is a compression spring located between the lip 30 on the sidewall 20 and the front flange 35. In such an embodiment, the spring 31 still biases the shield 14 into the advanced position, but does so by exerting an axially forward force from the lips 30 to the front flange 35.

The shield 14 can be moved out of the way when the connector 10 is applied—partially or fully—to a coaxial post 15. The shield 14 is mounted for reciprocal, slidable movement on the connector 10. When the connector 10 is registered with a coaxial post 15, it is advanced onto the coaxial post 15 by moving the connector 10 in the direction of the arrowed line E in FIG. 3. The front end of the coaxial post 15, well known to one having ordinary skill in the art, moves into the open interior 23 of the connector 10. Structure around the coaxial post 15, such as the plate or frame around the coaxial post 15, pushes the shield 14 rearward in the direction of the arrowed line R. The shield 14 is thus pushed back toward the retracted position in response to application of the connector 10 at least partially onto the coaxial post 15. In some cases, the user applying the connector 10 to a coaxial post 15 may grip the shield 14 and pull it back to the retracted position. This may aid the user in registering the center conductor 13 with the female socket in the coaxial post 15.

The connector 10 is preferably advanced along line E until the coaxial post 15 is fully seated in the interior 23. If the user has pulled the shield 14 back to the retracted position, the user now releases the shield 14. Because the spring 31 biases the shield 14 forward, the shield 14 snaps forward after being released, to as far forward a position as possible, in confrontation with structure around the coaxial post 15. In other words, when the user releases the shield 14, the shield 14 will move forward until its front end 33 confronts the structure around the coaxial post 15. This may be a short distance or a longer distance.

If, on the other hand, the user applied the connector 10 to the coaxial post 15 without first pulling the shield 14 back, then the shield 14 will simply move along the line R until the connector 10 is no longer moved forward along line E. The front end 33 of the shield 14 will already be advanced forward from the retracted position as much as possible—if at all —because it is pushed by the structure around the coaxial post 15. In other words, the shield 14 will be extended as far forward as possible, which may actually be no further forward than the fully retracted position of the shield 14.

With the coaxial post 15 received in the interior 23, and the shield 14 advanced forward in confrontation with the structure around the coaxial post 15, the shield 14 extends at least partially axially over the center conductor 13. FIG. 4 shows the connector 10 fully applied to the coaxial post 15. In this condition, the shield 14 is retracted and in confrontation with the structure around the coaxial post 15. The front end 33 of the shield 14 meets the structure around the coaxial post 15, thereby covering the center conductor 13 along its entire length.

If the connector 10 is not fully applied to the coaxial post 15, however, then the shield 14 will be forward of its retracted position. Nevertheless, the center conductor 13 will still be shielded. The shield 14, advanced slightly forward, still meets the structure around the coaxial post 15 in confrontation, thereby still radially covering the center conductor 13 along is entire length. Thus, in either scenario —whether the connector is fully applied to the coaxial post 15 or only partially applied—the shield 14 automatically deploys forward to provide RFI shielding for the center conductor 13 and the connector 10. And, when the connector 10 is removed from the coaxial post 15, the shield 14 automatically snaps into the advanced position, minimizing RFI ingress. Biased by the spring 31, the shield 14 will move toward the advanced position in response to removal of the connector 10 fully or partially from the coaxial post 15.

Some embodiments of the connector 10 include visual, audible, or haptic feedback to the user. For instance, in FIGS. 3 and 4, a small protrusion or tooth 40 is formed on the outer surface 26 of the barrel 12, projecting outwardly. The tooth 40 is flexible. When the shield 14 is retracted backward on the barrel 12, the rear flange 36 of the shield 14 slides into the tooth 40 and forces it to bend rearwardly. As the shield 14 continues to slide rearward, the flange 36 moves over the tooth 40, and the tooth 40 snaps back to its original position. When it snaps back, the tooth 40 vibrates the connector 10 slightly and makes a snapping or popping sound. In this way, the tooth 40 provides both haptic and audible feedback to the user, to confirm to the user that the shield 14 has been moved into the retracted position.

In another embodiment, the tooth 40 is rigid and forces the rear flange 36, and the sidewall 32 of the shield 14 on which it is formed, to bend and deform outwardly. In that embodiment, the sidewall 32 bends out of the way, and as the shield 14 is moved backward, the rear flange 36 snaps over the tooth 40 and back to its original position. When it snaps back, the rear flange 36 makes a snapping or popping sound, especially by contact with the outer surface 26 of the barrel 12. In this alternate way, the connector 10 provides both haptic and audible feedback to the user confirming that the shield 14 has been moved into the retracted position. In yet other embodiments, the tooth 40 may have different shapes and sizes, or may produce only haptic feedback or only audible feedback, or it may be formed on the inner surface of the shield 14 and engage with the lip 30 on the connector 10.

In an example of visual feedback, there is a visual indicator 41 extending around a portion of the outer surface 26 of barrel 12. When the shield 14 is in the advanced position thereof, the visual indicator 41 is exposed, as shown in FIGS. 1 and 3. In the drawings, the visual indicator 41 is a band of color, such as perhaps red, while in other embodiments, the visual indicator 41 may be words, symbols, or some other visual indication that identifies the shield 14 is in the advanced position, that the shield 14 is not in the retracted position, and/or that the coaxial post 15 may not be fully seated with the connector 10.

The visual indicator 41 highlights to the user that the shield 14 is in the advanced position. When the shield 14 is partially retracted, the visual indicator 41 is partially concealed and partially revealed. When the shield 14 is fully retracted, the visual indicator 41 is fully concealed, confirming to the user that the shield 14 has been fully retracted. The above description discloses describes a shield on a cable connector. The below description now discloses a shield on a coaxial post. Such posts or ports are often found on electronic components, such as on the backs of TVs, DVRs, cable boxes, splitters, taps, and like electronic components.

FIGS. 5-8 illustrates a shielded coaxial termination device (hereinafter, "post 60"). The post 60 is different from a conventional coaxial post. The post 60 includes a shield assembly 61 that mitigates RFI ingress and egress to and from the post 60, especially when a coaxial connector is fully or just partially captured on the post 60.

Figure 8:
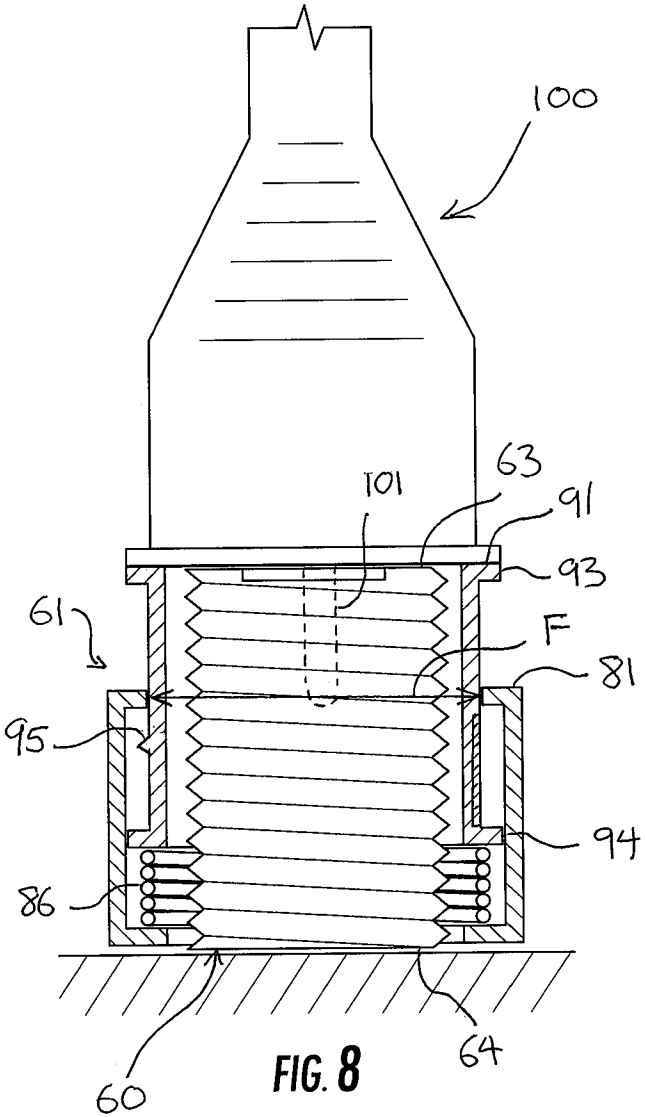
FIGS. 7 and 8 are section views taken along lines 7-7 and 8-8, showing the shielded coaxial termination device therein with the shield in the advanced and retracted positions, respectively.
Figure 7:
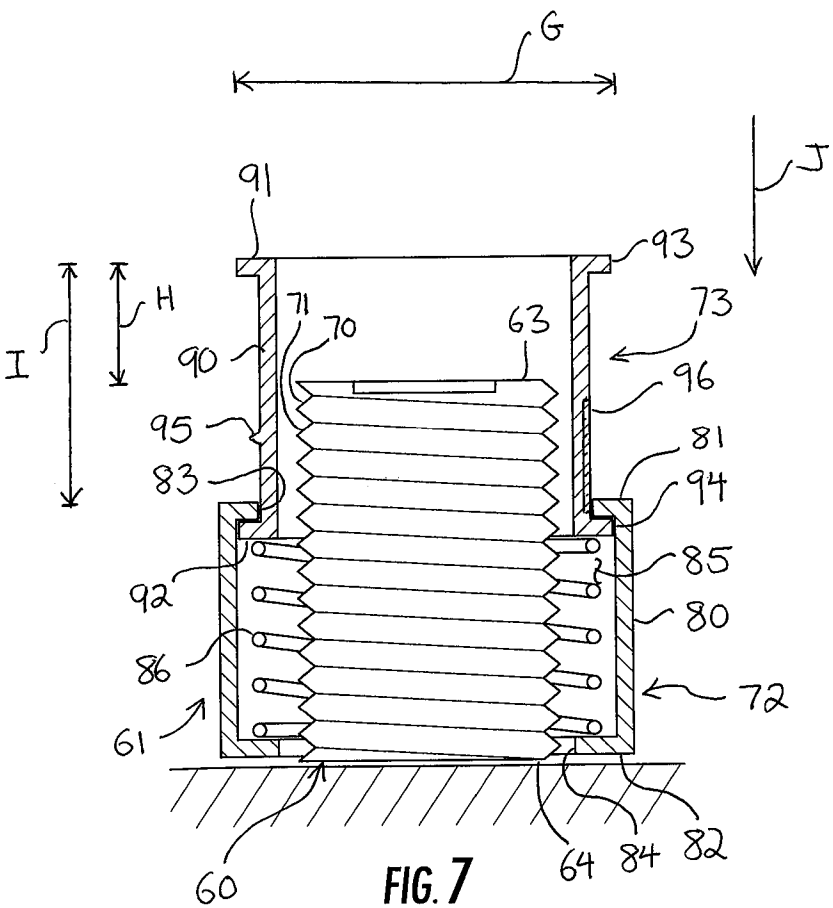

The post 60 includes a body 62 having a front end 63 and an opposed rear end 64 (shown in FIGS. 7 and 8). A socket 65 extends into the body 62 from the front end 63. The body 62 has an outer surface 70 formed with threads 71 for threadably engaging with complemental threads on a coaxial cable connector.

The shield assembly 61 includes a fixed mount 72 and a moveable shield 73 that reciprocates with respect to the mount 72 and the body 62 of the post 60. The mount 72 has a rigid cylindrical sidewall 80 extending between an open front end 81 and an open rear end 82. Inwardly-extending front and rear lips 83 and 84 are formed at the front and rear ends 81 and 82, respectively. The lips 83 and 84 each have a generally rectangular cross-section, extend continuously around the sidewall 80, and define an inner diameter F of the mount 72. This inner diameter F is slightly larger than the outer diameter as measured around the outer surface 70 of the body 62 of the post 60, thereby defining an annular interior gap or space 85 between the body 62 and the sidewall 80 of the mount 72 in which the shield 73 moves. The inner surface of the mount 72 is smooth, allowing the shield 73 to move in the interior space 85 along the inner surface smoothly.

The mount 72 is mounted around the threaded post body 62. The rear lip 84 is proximate the rear end 64 of the body 62, and the rear lip 84 serves as a rear stop for a spring 86 carried in the interior space 85 within the mount 72. The front lip 83 serves as a limiter for the moveable shield 73; it prevents the shield 73 from advancing off of the mount 72.

The shield 73 has a cylindrical sidewall 90 extending between an open front end 91 and an open rear end 92. Outwardly-extending flanges 93 and 94 are formed at the front end 91 and rear end 92, respectively. The flanges 93 and 94 each have a generally rectangular cross-section and define an outer diameter G, which is just larger than the inner diameter F and corresponds to the inner diameter of the sidewall 80 between the front and rear lips 83 and 84. The shield 73 is mounted in the interior space 85 within the mount 72 for reciprocal movement between an advanced position, shown in FIGS. 5 and 7, and a retracted position, shown in FIGS. 6 and 8. Because the outer diameter G is larger than the inner diameter of both of the lips 83 and 84, the shield 73 is prevented from sliding past the lips 83 and 84.

Figure 5:
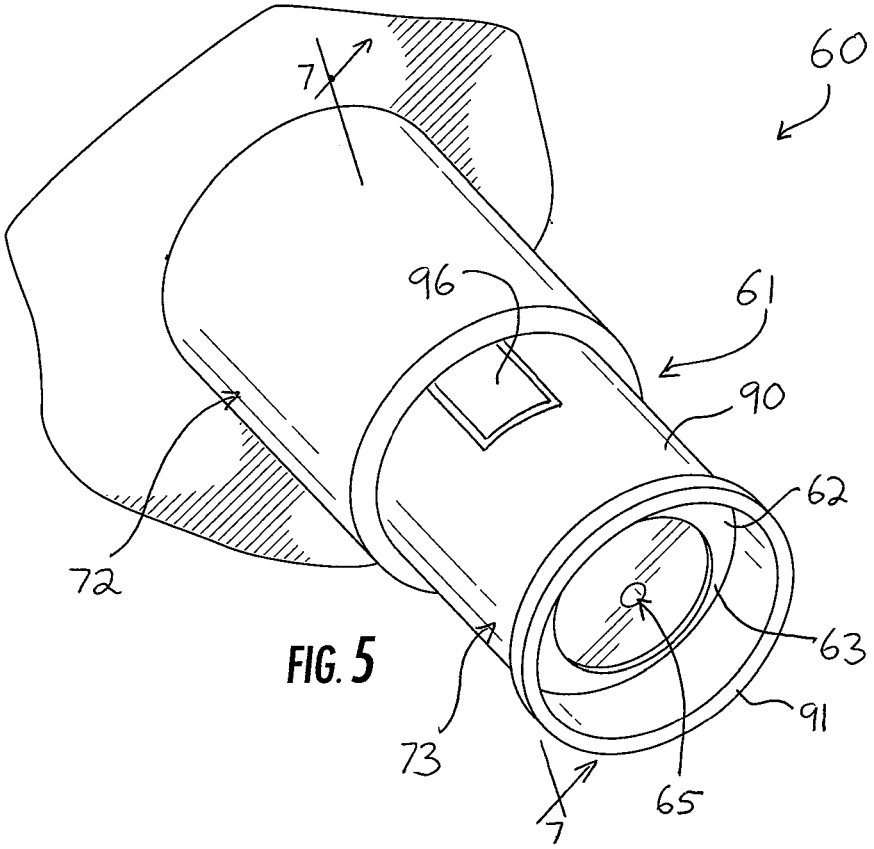
FIGS. 5 and 6 are perspective views of a shielded coaxial termination device with a shield in advanced and retracted positions, respectively.
Figure 6:
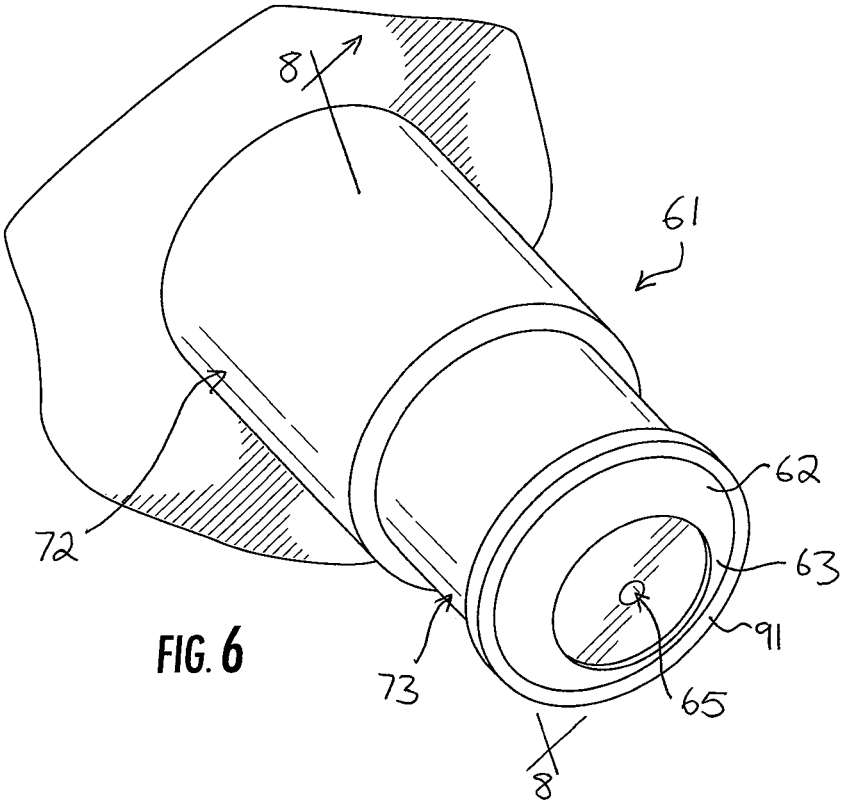

In the advanced position shown in FIGS. 5 and 7, the shield 73 is advanced forwardly so that it extends out beyond the front end 63 of the post 60. In this advanced position, the front end 91 of the shield 73 is spaced apart from the front end 63 of the body 62 by a distance H, as shown in FIG. 7. This distance H is approximately half a length I of the shield 73 between its front and rear ends 91 and 92.

The spring 86 is located axially between the rear flange 94 at the rear end 92 of the shield 73 and the rear lip 84 at the rear end 82 of the mount 72. The spring 86 is located radially within the interior space 85 between the post 60 and the sidewall 80 of the mount 72. The spring 86 is a compression spring, compressed between the lips 83 and 84 so that it biases the shield 73 into the advanced position. In an alternate embodiment of the post 60, the spring 73 is a tension spring located along an outer surface of the shield 73, between the lip 83 at the front end 81 of the mount 72 and the front flange 93 of the shield 73. In such an alternate embodiment, the spring 86 still biases the shield 73 into the advanced position, but does so by exerting an axially forward force from the lip 83 to the front flange 93.

When the shield 73 is in the advanced position, the front end 91 of the shield 73 is beyond the front end 63 of the post 60, thereby radially covering, concealing, and shielding the body 62 of the post 60. The shield 73 is constructed from a conductive material or combination of conductive materials suitable for blocking RFI ingress and egress, such as copper, nickel, aluminum, or other metal. When the shield 73 is in the advanced position thereof, RFI ingress and egress is limited in entering or leaving the post 60—and the electronic component from which it extends—through anywhere other than the mouth at the open front end 91 of the shield 73.

The shield 73 can be moved out of the way when a connector is applied at least partially thereto. The shield 73 is mounted for reciprocal, slidable movement on the mount 72. When a connector 100 is registered with the post 60 and is advanced toward the front end 63 of the post body 62, the front end of the connector 100 contacts the flange 93 at the front end 91 of the shield 73 and depresses the shield 73 into the mount 72 along line J, toward the retracted position shown in FIG. 8. In some cases, the user applying the connector 100 to the post 60 may grip the shield 73 and pull it back to the retracted position.

The connector 100 is preferably advanced until it is seated against the post 60 with its center conductor 101 received in the socket 65. Because it is biased toward the advanced position, the shield 73 will actually be extended as far forward or away from the rear end 82, as possible. Or, if the user has pulled the shield 73 back to the retracted position, the user can release the shield 73, and because it is biased by the spring 86, the shield 73 will snap forward to as far forward a position as possible, in confrontation with the front end of the connector 100.

With the connector 100 fully seated in the post 60, and the shield 73 advanced forward in confrontation with the front end of the connector 100, the shield 73 extends at least partially axially over the body 62 of the post 60 and the center conductor 101 of the connector 100. If the post 60 fully and properly captures the center conductor 101, as in FIG. 8, then the center conductor 101 will be covered by the body 62 of the post 60 and will be shielded not only by the body 62 but also by the shield 73 surrounding the body 62.

Connectors are not always properly seated in coaxial posts, however. If the post 60 only partially captures the center conductor 101, perhaps because the connector 100 is not fully seated on the post 60, then the center conductor 101 will still be covered radially by the shield 73. Even when the connector 100 is not fully installed on the coaxial post 60, however, the shield 73 provides RFI shielding for the center conductor 101, the connector 10, and the post 60 by deploying forward into confrontation with the front end of the connector 100, thereby encasing the center conductor 101 and the post 60. And, when the connector 100 is removed from the post 60, the shield 73 automatically snaps or deploys back into the advanced position, minimizing RFI ingress. Because the shield 73 is biased into the advanced position by the spring 86, when the connector 100 is disconnected from the post 60, the shield 73 automatically moves into the advanced position and blocks the ingress and egress of most RFI.

Some embodiments of the post 60 include visual, audible, or haptic feedback to the user. For instance, in FIGS. 5 and 6, a small protrusion or tooth 95 is formed on outer surface of the shield 73 and projects radially outward. The tooth 95 is flexible. When the shield 73 is retracted back within the mount 72, the lip 83 at the front end 81 of the mount 72 slides into the tooth 95 and forces it to bend forwardly. As the shield 73 continues to retract, the lip 83 moves over the tooth 95, and the tooth 95 snaps back to its original position. When it snaps back, the tooth 95 vibrates the post 60 slightly and makes a snapping or popping sound. In this way, the tooth 95 provides both haptic and audible feedback to the user, to confirm to the user that the shield 73 has been fully retracted. In other embodiments, the tooth 95 may have different shapes and sizes, or may produce only haptic feedback or only audible feedback, or it may be formed on the inner surface of the mount 72 and engage with the flange 94 at the rear end 92 of the shield 73.

In another embodiment, the tooth 95 is rigid and forces the front lip 83, and the sidewall 80 on which it is formed, to bend and deform outwardly. In that embodiment, the sidewall 80 bends out of the way, and as the shield 73 continues to move backward, the front lip 83 snaps over the tooth 95 and back to its original position. When it snaps back, the front lip 83 makes a snapping or popping sound, especially by contact with the outer surface of the sidewall 90 of the shield 73. In this alternate way, the post 60 provides both haptic and audible feedback to the user, confirming that the shield 73 has been moved into the retracted position. In yet other embodiments, the tooth 95 may have different shapes and sizes, or may produce only haptic feedback or only audible feedback, or it may be formed on the inner surface of the mount 72 and engage with the rear flange 94 as the shield 73 moves backward.

In an example of visual feedback, there is a visual indicator 96 extending around a portion of the outer surface of the sidewall 90 of the shield 73, proximate to the rear end 92. The visual indicator 96 highlights to the user that the shield 73 is in the advanced position. In the drawings, the visual indicator is a band of color, such as perhaps red, while in other embodiments, the visual indicator 96 may be words, symbols, or some other visual indication that identifies the shield 73 is in the advanced position and not in the retracted position, thereby indicating that the connector 100 may not be fully applied to the post 60. When the shield 73 is partially retracted, the visual indicator 96 is partially concealed and partially revealed. When the shield 73 is fully retracted, the visual indicator 96 is fully concealed, confirming to the user that the shield 73 has been fully retracted and that the connector 100 is fully seated in the post 60. There are other forms of visual feedback: the visual indicator 96 may be replaced with a word or words displaying a message to the user, for instance.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A shielded coaxial termination device comprising:

a center conductor having a front end;

a barrel encircling the center conductor, the barrel including a front end and an annular sidewall defining an interior configured to receive and electrically couple with a coaxial post; and a shield having a front end and an opposed rear end, wherein the shield is mounted to the barrel so as to deploy from a retracted position toward an advanced position to radially cover the center conductor when the barrel is not fully installed on a coaxial post.

2. The shielded coaxial termination device of claim 1, wherein:

in the advanced position of the shield, the front end of the shield is in front of the front end of the barrel and the rear end of the shield is behind the front end of the barrel; and in the retracted position of the shield, both the front and rear ends of the shield are behind the front end of the barrel.

3. The shielded coaxial termination device of claim 1, wherein:

in the advanced position of the shield, the front end of the shield is in front of the front end of the center conductor and the rear end of the shield is behind the front end of the barrel; and in the retracted position of the shield, both the front and rear ends of the shield is behind the front end of the center conductor.

4. The shielded coaxial termination device of claim 1, further comprising:

the shield is mounted outside the barrel;

an annular lip extending outwardly on the barrel;

front and rear flanges formed on the shield, both extending inwardly;

in the retracted position, the front flange encounters the annular lip, thereby preventing rearward movement of the shield on the barrel; and in the advanced position, forward movement of the shield on the barrel is prevented by indirect interaction of the lip and the rear flange.

5. The shielded coaxial termination device of claim 4, wherein a spring is tensioned between the annular lip and the rear flange.

6. The shielded coaxial termination device of claim 1, wherein the shield is biased toward the advanced position.

7. The shielded coaxial termination device of claim 1, wherein the shield produces haptic feedback when it moves from the advanced position to the retracted position.

8. The shielded coaxial termination device of claim 7, further comprising:

an outwardly-extending tooth formed on the barrel; and during movement of the shield from the advanced position to the retracted position, an inwardly-extending rear flange on the shield snaps over the tooth, thereby snapping and producing the haptic feedback.

9. The shielded coaxial termination device of claim 1, wherein the shield produces visual feedback when it moves into the retracted position.

10. The shielded coaxial termination device of claim 9, further comprising:

a visual indicator on the barrel;

in the advanced position of the shield, the visual indicator is revealed by the shield; and in the retracted position of the shield, the visual indicator is concealed by the shield.

11. A shielded coaxial termination device comprising:

a barrel having an annular sidewall and an interior configured to receive and electrically couple with a coaxial post;

a center conductor encircled by the sidewall;

a shield that moves between a retracted position and an advanced position over the barrel in which the shield radially covers the center conductor;

the shield moves toward the retracted position in response to application of the termination device at least partially onto a coaxial post; and the shield moves toward the advanced position in response removal of the termination device at least partially from the coaxial post.

12. A shielded coaxial termination device comprising:

a coaxial post having a front end, the coaxial post for receiving and electrically coupling with a coaxial cable connector;

a mount encircling the coaxial post, the mount including a front end and an annular sidewall defining an interior space between the coaxial post and the sidewall; and a shield having a front end and an opposed rear end, wherein the shield is mounted to the mount so as to deploy from a retracted position toward an advanced position to radially cover the coaxial post when the coaxial cable connector is not fully installed on the coaxial post.

13. The shielded coaxial termination device of claim 12, wherein in the advanced position of the shield, the front end of the shield is in front of the front end of the coaxial post and the rear end of the shield is behind the front end of the coaxial post.

14. The shielded coaxial termination device of claim 12, further comprising:

front and rear annular lips extending inwardly on the mount;

front and rear flanges formed on the shield, both extending outwardly; and in the advanced position of the shield, the rear flange encounters the front annular lip and prevents further forward movement of the shield on the mount.

15. The shielded coaxial termination device of claim 12, wherein a spring is compressed between the rear annular lip of the mount and the rear flange of the shield.

16. The shielded coaxial termination device of claim 12, wherein the shield is biased toward the advanced position.

17. The shielded coaxial termination device of claim 12, wherein the shield produces haptic feedback when it moves from the advanced position to the retraced position.

18. The shielded coaxial termination device of claim 17, further comprising:

an outwardly-extending tooth formed on the shield; and during movement of the shield from the advanced position to the retracted position, an inwardly-extending front lip on the mount snaps over the tooth, thereby snapping and producing the haptic feedback.

19. The shielded coaxial termination device of claim 12, wherein the shield produces visual feedback when it moves into the retracted position.

20. The shielded coaxial termination device of claim 19, further comprising:

a visual indicator on the shield;

in the advanced position of the shield, the visual indicator is revealed by the mount; and in the retracted position of the shield, the visual indicator is concealed by the mount.

* * * * *